US010147386B1

(12) United States Patent
Wang

(10) Patent No.: US 10,147,386 B1
(45) Date of Patent: Dec. 4, 2018

(54) DRIVE SYSTEM AND DRIVE METHOD OF LIQUID CRYSTAL DISPLAY

(71) Applicant: Shenzhen China Star Optoelectronics Technology Co., Ltd., Shenzhen, Guangdong (CN)

(72) Inventor: Mingliang Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/304,519

(22) PCT Filed: Sep. 20, 2016

(86) PCT No.: PCT/CN2016/099493
§ 371 (c)(1),
(2) Date: May 11, 2018

(87) PCT Pub. No.: WO2018/010296
PCT Pub. Date: Jan. 18, 2018

(30) Foreign Application Priority Data

Jul. 13, 2016 (CN) ..... 2016 1 0550754

(51) Int. Cl.
*G09G 3/36* (2006.01)

(52) U.S. Cl.
CPC ..... *G09G 3/3696* (2013.01); *G09G 3/3614* (2013.01); *G09G 3/3688* (2013.01)

(58) Field of Classification Search
CPC ... G09G 3/3696; G09G 3/3688; G09G 3/3614
See application file for complete search history.

(56) References Cited

U.S. PATENT DOCUMENTS

2008/0180419 A1* 7/2008 Tung ..... G09G 3/3655 345/204
2008/0224980 A1* 9/2008 Senda ..... G09G 3/3648 345/96
2012/0081352 A1 4/2012 Yamagishi
2012/0274624 A1* 11/2012 Lee ..... G09G 3/3648 345/213
2013/0002145 A1* 1/2013 Hwang ..... G09G 3/36 315/158

(Continued)

FOREIGN PATENT DOCUMENTS

CN 102243849 A 11/2011
CN 102479480 A 5/2012

(Continued)

*Primary Examiner* — Ryan A Lubit
(74) *Attorney, Agent, or Firm* — Andrew C. Cheng

(57) ABSTRACT

A drive system of a liquid crystal display is provided. The drive system includes: a signal controller configured to generate a control signal and an image data; a common voltage generator configured to detect the control signal and generate a common voltage according to the detecting; and a data driver configured to provide a data voltage corresponding to the image data according to the control signal, and to output the data voltage according to the control signal, wherein the common voltage generated by common voltage generator and the data voltage output by the data driver are both provided to pixels of the liquid crystal display. A drive method of the liquid crystal display is also provided.

12 Claims, 2 Drawing Sheets

(56) References Cited

U.S. PATENT DOCUMENTS

| | | | | |
|---|---|---|---|---|
| 2014/0092077 | A1* | 4/2014 | Kim | G09G 3/3611<br>345/212 |
| 2017/0345386 | A1* | 11/2017 | Seo | G09G 3/3611 |
| 2017/0345388 | A1* | 11/2017 | Hwang | G09G 3/20 |

FOREIGN PATENT DOCUMENTS

| | | | |
|---|---|---|---|
| CN | 103730084 | A | 4/2014 |
| CN | 104766582 | A | 7/2015 |
| CN | 104795035 | A | 7/2015 |
| CN | 105702221 | A | 6/2016 |
| KR | 20130057701 | A | 6/2013 |
| KR | 101429912 | B1 | 8/2014 |

* cited by examiner

DRIVE SYSTEM AND DRIVE METHOD OF LIQUID CRYSTAL DISPLAY

TECHNICAL FIELD

The present disclosure relates to the field of liquid crystal display technology, in particular, to a drive system and a drive method of a liquid crystal display.

BACKGROUND ART

With the development of photoelectricity and semiconductor technology, flat panel display is booming. Liquid crystal display (LCD) in numerous flat displays has been applied in various aspects of production and living for its favorable characteristics such as high efficient in space utilization, low power consumption, radiationless and low disturbance of electromagnetism etc.

The drive system of the liquid crystal display generally includes a data driver, a signal controller and a common voltage generator. The signal controller provides an image data and a control signal to the data driver, wherein the control signal includes an output enable signal and a polarity reversal signal. When the falling edge of the output enable signal arrivals, the data driver outputs a positive polarity pixel voltage or a negative polarity pixel voltage relative to a common voltage generated by the common voltage generator according to the polarity reversal signal, to provide to each pixel of the liquid crystal display.

However, the common voltage generator is independent, and it is not controlled by the signal controller. Thus, when the signal controller does not output an image data and a control signal since it crashed in an abnormal state, the data driver would not output any signal, by this time, the common voltage generator still generates a common voltage (i.e., a direct voltage) normally and transmits it to each pixel, such that each pixel has been driven by the direct voltage, which results in the polarization of liquid crystal molecules after a long time, thereby the liquid crystal moleculars lose normal deflection function causing a display failure.

SUMMARY

To solve the above problem existing in the prior art, an object of the present disclosure is to provide a drive system of a liquid crystal display, which includes: a signal controller configured to generate a control signal and an image data; a common voltage generator configured to detect the control signal and generate a common voltage according to the detecting; and a data driver configured to provide a data voltage corresponding to the image data according to the control signal, and to output the data voltage according to the control signal, wherein the common voltage generated by common voltage generator and the data voltage output by the data driver are provided to pixels of the liquid crystal display.

Further, the control signal includes a polarity reversal signal and an output enable signal of the data driver; and the common voltage generator is further configured to detect whether the polarity reversal signal and the output enable signal normally and alternately switch in a high-level signal and a low-level signal, and generates a common voltage according to the detecting.

Further, the common voltage generator is further configured to generate a common voltage when it is detected that the polarity reversal signal and the output enable signal both alternately switch in a high-level signal and a low-level signal in a normal state.

Further, the common voltage generator is further configured to not generate a common voltage when it is detected that at least one of the polarity reversal signal and the output enable signal fails to alternately switch in a high-level signal and a low-level signal in a normal state.

Further, the control signal includes: a polarity reversal signal and an output enable signal of the data driver; and the data driver is further configured to select a data voltage corresponding to the image data according to the polarity reversal signal, and output the selected data voltage according to the output enable signal.

Another object of the present invention is to provide a drive method of the liquid crystal display, which includes: generating a control signal and an image data; and detecting the control signal and generating a common voltage according to the detecting, wherein the generated common voltage is provided to pixels of the liquid crystal display; and providing a data voltage corresponding to the image data according to the control signal, and outputting the data voltage according to the control signal, wherein output data voltage is provided to pixels of the liquid crystal display.

Further, the control signal includes: a polarity reversal signal and an output enable signal of the data driver; and wherein a concrete method of detecting the control signal and generating a common voltage according to the detecting includes: detecting whether the output enable signal normally and alternately switches in a high-level signal and a low-level signal; detecting whether the polarity reversal signal normally and alternately switches in a high-level signal and a low-level signal if it is detected that the output enable signal alternately switches in a high-level signal and a low-level signal in a normal state; generating a common voltage if it is detected that the polarity reversal signal normally and alternately switches in a high-level signal and a low-level signal.

Further, the concrete method of detecting the control signal and generating the common voltage according to the detecting also includes: not generating the common voltage if it is detected that the output enable signal fails to normally alternately switch in a high-level signal and a low-level signal.

Further, the concrete method of detecting the control signal and generating the common voltage according to the detecting also includes: not generating the common voltage if it is detected that the polarity reversal signal fails to normally alternately switch in a high-level signal and a low-level signal.

Further, the control signal includes: a polarity reversal signal and an output enable signal of the data driver; and wherein the concrete method of providing a data voltage corresponding to the image data according to the control signal and outputting the data voltage according to the control signal, includes: selecting the data voltage corresponding to the image data according to the polarity reversal signal; and outputting the selected data voltage according to the output enable signal.

The present invention has advantageous effects as follows: it may be determined whether the signal controller works normally by detecting whether the control signal output by the signal controller is abnormal, and then judging whether to output common voltage to pixels, so when the signal controller is abnormal and the data drive cannot output the data voltage, the common voltage generator may not generate the common voltage to the pixels, thus it can prevent the liquid crystal molecule from being polarized for being independently direct-current driven due to receiving the common voltage.

BRIEF DESCRIPTION OF THE DRAWINGS

These and/or other aspects, characteristics and advantages of the embodiments in the present disclosure will become apparent and more readily appreciated from the following description, taken in conjunction with the accompanying drawings, in which.

DETAILED DESCRIPTION OF EXEMPLARY EMBODIMENTS

Embodiments of the present invention will be described in detail below by referring to the accompany drawings. However, the present disclosure can be implemented in numerous different forms, and the present disclosure should not be explained to be limited thereto. Instead, these embodiments are provided for explaining the principle and actual application of the present invention, and thus other skilled in the art can understand various embodiments and amendments which are suitable for specific intended applications of the present invention.

Figure 1:
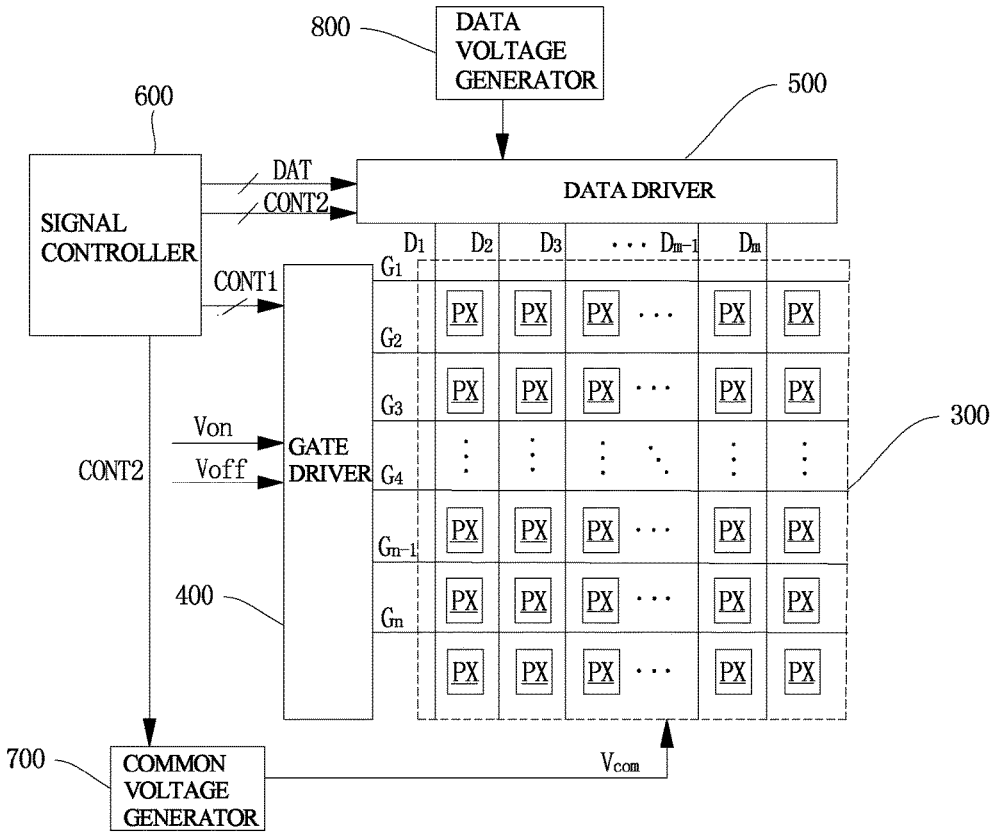
FIG. 1 is a block diagram of the liquid crystal display according to an embodiment of the present invention.

FIG. 1 is a block diagram of the liquid crystal display according to an embodiment of the present invention.

Referring to FIG. 1, the liquid crystal display according to an embodiment of the present invention includes: a liquid crystal panel assembly 300; a gate driver 400, a data driver 500 and a common voltage generator 700 all being connected to the liquid crystal panel assembly 300; a data voltage generator 800 connected to the data driver 500; and a signal controller 600 for controlling the liquid crystal panel assembly 300, the gate driver 400, the data driver 500 and the common voltage generator 700.

The liquid crystal display assembly 300 includes a plurality of display signal lines and a plurality of pixels PX connected to the display signal lines and arranged in an array. The liquid crystal panel assembly 300 may include a lower display panel (not show) and an upper display panel (not show) facing with each other, and a liquid crystal layer (not show) inserted between the lower display panel and the upper display panel.

The display signal lines can be arranged on the lower display panel. The display signal lines may include a plurality of gate lines G1 to Gn for transmitting gate signals and a plurality of data lines D1 to Dm for transmitting data signals. The gate lines G1 to Gn extend in a row direction and are substantially parallel to each other, and the data lines D1 to Dm extend in a column direction and are substantially parallel to each other.

Each pixel PX includes: a switch device connected to the corresponding gate line and the corresponding data line; and a liquid crystal capacitor connected to the switch device. If necessary, each pixel PX may also include a storage capacitor, which is connected to the liquid crystal capacitor in parallel.

The switch device of each pixel PX is a three-terminal device, and thus the switch device has a control terminal connected to the corresponding gate line, an input terminal connected the corresponding data line and an output terminal connected to the corresponding liquid crystal capacitor.

The gate driver 400 is connected to the gate lines G1 to Gn and applies gate signals to the gate lines G1 to Gn. The gate signals are a combination of a gate turn-on voltage Von and a gate turn-off voltage Voff, which are provided to the gate driver 400 from an external source. Referring to FIG. 1, one side of the liquid crystal panel assembly 300 is provided with a gate driver 400, and the gate lines G1 to Gn are all connected to the gate driver 400. However, the present invention is not limited thereto. That is to say, opposite sides of the liquid crystal panel assembly 300 can be respectively provided with a gate driver, and the gate lines G1 to Gn are all connected to each one of these two gate drivers.

The common voltage generator 700 generates a common voltage Vcom and applies the generated common voltage Vcom to respective pixel PX.

The data voltage generator 800 generates a plurality of data voltages that are closely related to the transmittance of the pixel PX. The data voltages are provided to each pixel PX and have positive values (or called positive polarity) and negative values (or called negative polarity) according to the common voltage Vcom.

The data driver 500 is connected to the data lines D1 to Dm of the liquid crystal panel assembly 300, and applies the data voltages generated by the data voltage generator 800 to the pixels PX.

The signal controller 600 controls operations of the gate driver 400, the data driver 500 and the common voltage generator 700

The signal controller 600 receives an input image signal from an external graphic controller (not shown) and makes a proper process to the input image signal, to generate an image data DAT fitting for the operating condition of the liquid crystal panel assembly 300. Then, the signal controller 600 generates a gate control signal CONT1 and a data control signal CONT2, to transmit the gate control signal CONT1 to the gate driver 400, to transmit the data control signal CONT2 and the image data DAT to the data driver 500, and to transmit the data control signal CONT2 to the common voltage generator 700.

The gate control signal CONT1 may include: a scanning start signal STV for starting the operation (namely, scanning) of the scan driver 400; and at least one clock signal for controlling when the gate turn-on voltage Von is output. The gate control signal CONT1 may also include an output enable signal for limiting duration of the gate turn-on voltage Von.

The data control signal CONT2 may include: a horizontal sync start signal which indicates a transmission of the image data DAT; an output enable signal which requests to apply the data voltage corresponding to the image data DAT to the data lines D1 to Dm; and a data clock signal. The data control signal CONT2 may also include a polarity reversal signal for reversing a polarity of the data voltage relative to the common voltage Vcom.

The data driver 500 receives the image data DAT from the signal controller 600 in response to the data control signal CONT2, and selects a data voltage corresponding to the image data DAT from the plurality of data voltages provided by the data voltage generator 800. Then, the data driver 500 supplies the data voltage to the data lines D1 to Dm. Further, the data driver 500 selects a data voltage corresponding to the image data DAT from the plurality of data voltages provided by the data voltage generator 800 according to the polarity reversal signal, and outputs the selected data voltage according to the output enable signal.

The gate driver 400 applies the gate turn-on voltage Von to the gate lines G1 to Gn in response to the gate control signal CONT1, so as to turn on the switch devices connected to the gate lines G1 to Gn. Then, the data voltage provided to the data lines D1 to Dm is transmitted to each pixel PX via the switch devices which are turned on.

A difference between the data voltage and the common voltage Vcom provided to each pixel PX can be interpreted as a voltage for charging the liquid crystal capacitor of each pixel PX, namely, a pixel voltage. The arrangement of the liquid crystal moleculars in the liquid crystal layer changes in accordance with the magnitude of the pixel voltage, and thus the polarity of the light transmitted through the liquid crystal layer may also change, which causes a variation of the transmittance of the liquid crystal layer Below, the course of generating the common voltage Vcom by the common voltage generator 700 according to an embodiment of the present invention will be described in detail.

In particular, the common voltage generator 700 is configured to detect the data control signal CONT2 and generate a common voltage Vcom according to the result of the detecting. In the present embodiment, the common voltage generator 700 is configured to detect whether the polarity reversal signal and the output enable signal of the data control signal CONT2 both alternately switch in a high-level signal and a low-level signal in a normal state, and generates a common voltage Vcom according to the detecting.

Further, the common voltage generator 700 may generate the common voltage Vcom when it is detected that the polarity reversal signal and the output enable signal in the data control signal CONT2 both normally and alternately switch in a high-level signal and a low-level signal.

The common voltage generator may not generate the common voltage Vcom when it is detected that at least one of the polarity reversal signal and the output enable signal fails to normally alternately switch in a high-level signal and a low-level signal. Thus, when the signal controller 600 is abnormal, the data drive 500 cannot output the data voltage, and since data control signal CONT2 provided to the common voltage generator 700 by the signal controller 600 may be abnormal as well, the common voltage generator 700 may not generate the common voltage Vcom, which can prevent the liquid crystal molecules from being independently direct-current driven due to receiving the common voltage Vcom.

Figure 2:
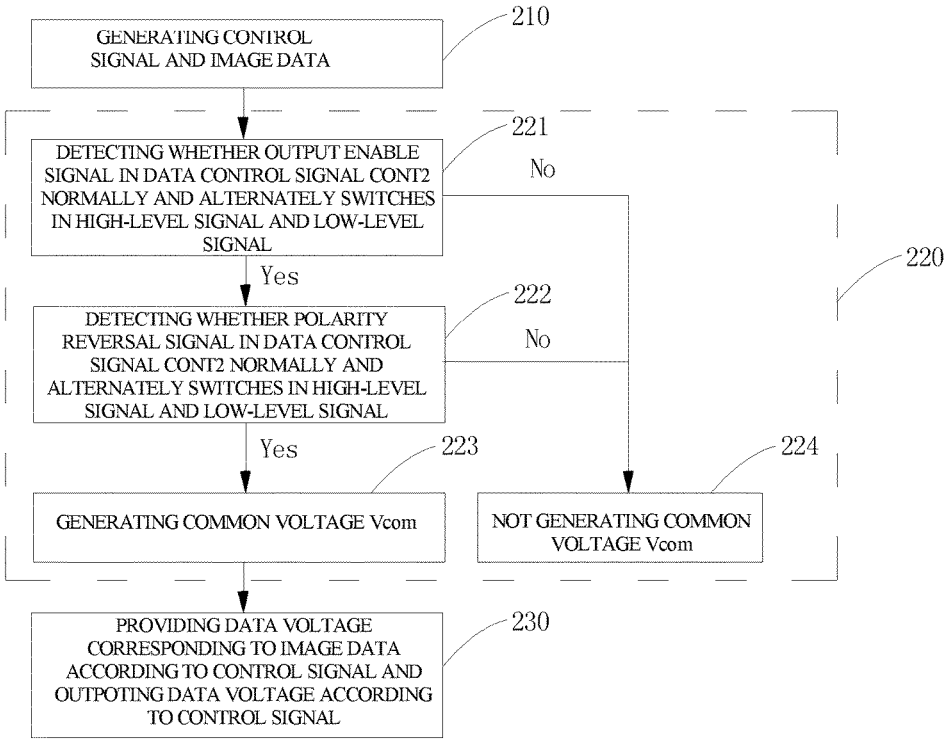
FIG. 2 is a flow chart of the drive method of the liquid crystal display according to an embodiment of the present invention.

FIG. 2 is a flow chart of the drive method of the liquid crystal display according to an embodiment of the present invention.

Referring to FIGS. 1-2, in the step 210, the signal controller 600 generates a control signal (it includes a gate control signal CONT1 and a data control signal CONT2) and an image data DAT. Here, please refer to the above illustrations for the process of generating the control signal and the image data DAT by the signal controller 600.

In step 220, the common voltage generator 700 detects the data control signal CONT2 and generates a common voltage Vcom according to the detecting, wherein the common voltage Vcom generated by the common voltage generator 700 is provided to the pixels PX of the liquid crystal display.

Particularly, the step 220 includes a step 221, a step 222, a step 223 and a step 224.

In step 221, the common voltage generator 700 detects whether the output enable signal in the data control signal CONT2 normally and alternately switches in a high-level signal and a low-level signal.

If the common voltage generator 700 detects that the output enable signal in the data control signal CONT2 alternately switches in a high-level signal and a low-level signal in a normal state, the step 222 is performed. If the common voltage generator 700 detects that the output enable signal in the data control signal CONT2 fails to normally alternately switch in a high-level signal and a low-level signal, the step 224 is performed.

In step 222, the common voltage generator 700 detects whether the polarity reversal signal in the data control signal CONT2 normally and alternately switches in a high-level signal and a low-level signal.

If the common voltage generator 700 detects that the polarity reversal signal in the data control signal CONT2 alternately switches in a high-level signal and a low-level signal in a normal state, the step 223 is performed. If the common voltage generator 700 detects that the polarity reversal signal in the data control signal CONT2 fails to normally and alternately switch in a high-level signal and a low-level signal, the step 224 is performed.

In step 223, the common voltage generator 700 generates the common voltage Vcom.

In step 224, the common voltage generator 700 does not generate the common voltage Vcom.

In step 230, the data driver 500 provides a data voltage corresponding to the image data DAT according to the data control signal CONT2, and outputs the data voltage according to the data control signal CONT2. The data voltage output by the data driver 500 is provided to the pixels PX of the liquid crystal display.

Specifically, the data driver 500 selects the data voltage corresponding to the image data DAT according to the polarity reversal signal in the data control signal CONT2, and outputs the selected data voltage according to the output enable signal. Please refer to above illustrations for the detailed process.

In summary, according to the embodiment of the present invention, it is determined whether the signal controller works normally through detecting whether the control signal output by the signal controller is abnormal, and thus it can be judged whether to output common voltage to pixels, so when the signal controller is abnormal and the data drive cannot output the data voltage, the common voltage generator may not generate the common voltage to the pixels, which can prevent the liquid crystal molecule from being polarized for being independently direct-current driven by receiving the common voltage.

Although the present disclosure is described with reference to the special embodiments, while those skilled in the art will understand that various changes in form and details may be made therein without departing from the spirit and scope of the invention as defined by the appended claims and its equivalents.

What is claimed is:

1. A drive system of a liquid crystal display, comprising:

a signal controller configured to generate a control signal and an image data;

a common voltage generator configured to detect the control signal and generate a common voltage according to the detecting; and a data driver configured to provide a data voltage corresponding to the image data according to the control signal, and to output the data voltage according to the control signal, wherein the common voltage generated by common voltage generator and the data voltage output by the data driver are both provided to pixels of the liquid crystal display, and wherein the control signal comprises a polarity reversal signal and an output enable signal of the data driver.

2. The drive system of claim 1, wherein the control signal comprises: a polarity reversal signal and an output enable signal of the data driver; and the common voltage generator is further configured to detect whether the polarity reversal signal and the output enable signal both normally and alternately switch in a high-level signal and a low-level signal, and generate a common voltage according to the detecting.

3. The drive system of claim 2, wherein the common voltage generator is further configured to generate the common voltage when it detects that the polarity reversal signal and the output enable signal both normally and alternately switch between a high-level signal and a low-level signal.

4. The drive system of claim 2, wherein the common voltage generator is further configured to not generate the common voltage when it detects that at least one of the polarity reversal signal and the output enable signal fails to normally and alternately switch between a high-level signal and a low-level signal.

5. The drive system of claim 3, wherein the common voltage generator is further configured to not generate the common voltage when it detects that at least one of the polarity reversal signal and the output enable signal fails to normally alternately switch between a high-level signal and a low-level signal.

6. The drive system of claim 1, wherein the data driver is further configured to select a data voltage corresponding to the image data according to the polarity reversal signal, and output the selected data voltage according to the output enable signal.

7. A drive method of a liquid crystal display, comprising:

generating a control signal and an image data;

detecting the control signal and generating a common voltage according to the detecting, wherein the generated common voltage is provided to pixels of the liquid crystal display; and providing a data voltage corresponding to the image data according to the control signal, and outputting the data voltage according to the control signal, wherein the output data voltage is provided to pixels of the liquid crystal display, and wherein the control signal comprises a polarity reversal signal and an output enable signal of the data driver.

8. The drive method of claim 7, wherein the control signal comprises: a polarity reversal signal and an output enable signal of the data driver, wherein the detecting the control signal and generating a common voltage according to the detecting comprises:

detecting whether the output enable signal normally and alternately switches in a high-level signal and a low-level signal;

detecting whether the polarity reversal signal normally and alternately switches in a high-level signal and a low-level signal when it is detected that the output enable signal normally and alternately switches in a high-level signal and a low-level signal; and generating a common voltage when it is detected that the polarity reversal signal normally and alternately switches in a high-level signal and a low-level signal.

9. The drive method of claim 8, wherein the concrete method of detecting the control signal and generating the common voltage according to the detecting further comprises: not generating the common voltage when it is detected that the output enable signal fails to normally and alternately switch in a high-level signal and a low-level signal.

10. The drive method of claim 8, wherein the concrete method of detecting the control signal and generating the common voltage according to the detecting further comprises: not generating the common voltage when it is detected that the polarity reversal signal fails to normally and alternately switch in a high-level signal and a low-level signal.

11. The drive method of claim 9, wherein a concrete method of detecting the control signal and generating the common voltage according to the detecting further comprises: not generating the common voltage when it is detected that the polarity reversal signal fails to normally and alternately switch in a high-level signal and a low-level signal.

12. The drive method of claim 7, wherein the control signal comprises: a polarity reversal signal and an output enable signal of the data driver, wherein the concrete method of providing a data voltage corresponding to the image data according to the control signal and outputting the data voltage according to the control signal, comprises:

selecting the data voltage corresponding to the image data according to the polarity reversal signal; and outputting the selected data voltage according to the output enable signal.

* * * * *